United States Patent [19]

Beck et al.

[11] Patent Number: 4,657,534

[45] Date of Patent: Apr. 14, 1987

[54] DUAL COMPARTMENT, DISPOSABLE, MIXING AND DISPENSING CONTAINER

[75] Inventors: Robert E. Beck, Fort Worth, Tex.; Frank E. Brown, Burbank, Calif.; Michael J. Jobe, Fort Worth, Tex.

[73] Assignee: Alcon Laboratories, Inc., Fort Worth, Tex.

[21] Appl. No.: 794,360

[22] Filed: Nov. 4, 1985

[51] Int. Cl.[4] ..... B67D 5/60

[52] U.S. Cl. ..... 604/90; 604/89; 604/231; 604/184

[58] Field of Search ..... 604/87–90, 604/184, 231, 410

[56] References Cited

U.S. PATENT DOCUMENTS

| | | | |
|---|---|---|---|
| 2,494,456 | 1/1950 | Still | 128/272 |
| 2,568,029 | 9/1951 | Seemar | 128/272 |
| 2,653,610 | 9/1953 | Smith | 128/272 |
| 2,653,611 | 9/1953 | Smith | 128/272 |
| 2,900,100 | 8/1959 | DeBat et al. | 215/6 |
| 3,464,414 | 9/1969 | Sponnoble | 128/272 |
| 3,539,794 | 11/1970 | Rauhut et al. | 240/2.25 |
| 3,563,415 | 2/1971 | Ogle | 604/90 |
| 3,595,439 | 7/1971 | Newby et al. | 222/80 |
| 3,684,136 | 8/1972 | Baumann | 222/386 |
| 3,715,189 | 2/1973 | Nighohossian et al. | 23/259 |
| 3,720,523 | 3/1973 | Nakagami | 99/171 |
| 3,731,853 | 5/1973 | Baumann et al. | 222/386 |
| 3,739,947 | 6/1973 | Baumann et al. | 222/136 |
| 3,741,383 | 6/1973 | Wittwer | 206/47 |
| 3,756,390 | 9/1973 | Abbey et al. | 206/47 |
| 3,785,481 | 1/1974 | Allet-Coche | 206/47 |
| 3,809,225 | 5/1974 | Allet-Coche | 206/220 |
| 4,102,451 | 7/1978 | Clarke et al. | 206/219 |
| 4,193,698 | 3/1980 | Gartner | 366/130 |
| 4,496,344 | 1/1985 | Kamstra | 604/90 |
| 4,515,586 | 5/1985 | Mendenhall et al. | 604/89 |

*Primary Examiner*—C. Fred Rosenbaum
*Assistant Examiner*—Sherri E. Vinyard
*Attorney, Agent, or Firm*—James A. Arno; Gregg C. Brown

[57] ABSTRACT

A package for materials that are to be mixed just prior to use comprises a squeezable container into which is inserted a barrel containing a plunger. One substance to be mixed is placed within the container. The second substance is placed within a compartment formed within the barrel between a pair of pistons having flexible sealing rings. Telescoping of the plunger rod into the barrel causes the upper piston to advance into the compartment. The advancing upper piston exerts hydraulic pressure causing the lower sealing piston to detach from the barrel allowing internal mixing of the substances into a mixed fluid. By squeezing the container side wall, mixed fluid may be dispensed from a forward end of the plunger rod communicating with the container interior through a series of passageways.

12 Claims, 3 Drawing Figures

DUAL COMPARTMENT, DISPOSABLE, MIXING AND DISPENSING CONTAINER

BACKGROUND OF THE INVENTION

1. Field of the Invention

The present invention generally relates to containers formed with separate compartments for storage of separate substances with a removable partition to permit internal mixing of said substances to form a mixed fluid dispensable from the container.

2. Discussion of Related Art

Various designs have been utilized in the syringe and pharmaceutical container arts to provide for the mixing of two substances. These designs have frequently involved systems wherein one of the two substances is a solid drug (e.g., a drug powder) and the other of the two substances is a solvent suitable for reconstituting the drug powder to form a solution. Many of these container designs are provided with a rubber plug or other type of closure which allows the mixture of substances to be drawn up into a hypodermic syringe. Reference is made to the following U.S. patents for further details and background regarding such syringes and containers: U.S. Pat. Nos. 2,494,456; 2,568,029; 2,653,610; 2,900,100; 3,464,414; 3,539,794; 3,595,439; 3,684,136; 3,715,189; 3,720,523; 3,731,853; 3,739,947; 3,741,383; 3,756,390; 3,785,481; 3,809,225; 4,102,451; and 4,193,698. The container of the present invention is specially adapted for the mixing and dispensing of sterile irrigating solutions.

Sterile irrigating solutions are often used during intraocular surgical procedures requiring a relatively long perfusion time. One type of irrigating solution which can be dispensed with the present invention is BSS PLUS®, which is a solution consisting of two separate parts which are mixed aseptically immediately prior to use. BSS PLUS® is disclosed and claimed in commonly assigned U.S. patent application Ser. No. 582,564, the entire contents of which are incorporated herein by reference.

As presently used, BSS PLUS® Parts I and II are stored in separate containers. Immediately prior to use, it is necessary to clean and disinfect rubber stoppers on both containers by using sterile alcohol wipes. Thereupon, the contents of the Part II vial are transferred to the Part I bottle utilizing a vacuum transfer device. An alternate method of solution transfer may be accomplished by using a syringe to remove the Part II solution from the vial and transferring it to the Part I container through the target area of the rubber stopper. An excess volume of Part II is provided in each vial. The container is then gently agitated to mix the solution. A sterile dispensing plastic spike is then inserted into the container to dispense the fluid so that intraocular irrigation can begin.

Storage of Parts I and II of BSS PLUS® in separate vials followed by reconstitution in the manner described above is time consuming and requires the use of two hands. Further, strict aseptic procedures similar to those used for intravenous products must be followed during the reconstitution of BSS PLUS®.

It is accordingly an object of the present invention to provide a dual compartment container for aseptic, separate storage and internal mixing of two substances to form a mixed fluid dispensable from the container at time of use.

Another object of the invention is to provide a container wherein mixing of the separate substances is convenient and does not require the use of strict aseptic procedures at the time of mixing.

Still another object is to provide a two-part container which ensures that both substances are thoroughly mixed prior to use and completely dispensed from the container by forming the container with a squeezable wall.

A still further object is to provide a dual compartment disposable syringe package for separate storage of Parts I and II of BSS PLUS® and Internal mixing of Parts I and II within the container to form the reconstituted product.

SUMMARY OF THE INVENTION

A dual compartment dispensing container for storage of separate substances with provision for internal mixing of same to form a single mixed fluid dispensable from the container is disclosed. In accordance with the invention, the dispensing container comprises a container side wall forming an interior volumetric region for storage of one of the substances. A barrel assembly received within the container is formed with a compartment for storage of another substance. The barrel assembly has a stopper defining the lower end of the compartment. The stopper separates the stored substances from each other prior to mixing.

A plunger rod is disposed in the barrel in coaxial alignment with the compartment and includes a piston defining the upper end of the compartment. By depressing the plunger rod, the advancing piston exerts hydraulic pressure causing the lower piston to become unplugged from the lower end of the barrel to allow internal mixing of the substances. The mixed fluid is thereupon dispensed from the container through a forward end of the plunger rod located outside the container and in communication with the mixed fluid through a series of passageways in the rod and inlet ports formed in the barrel.

Preferably, the container side wall is formed of a flexible material squeezable to dispense mixed fluid from the container. Upon squeezing the container side wall, subsequent to telescoping the plunger rod into the barrel assembly to achieve internal mixing, the mixed fluid is dispensed through the forward end of the plunger by traveling through the inlet ports in communication with the forward end through a longitudinal passage, a cross passage and an annular passage in the plunger rod.

A syringe is preferably fixed to the plunger rod by means of a luer lock mechanism formed in the forward end.

The two substances are easily and aseptically mixed for dispensing as a mixed solution by manually holding the container with one hand while applying finger pressure to depress the plunger rod until it is completely seated within the barrel. The substances are then further mixed by shaking the container. Following removal of the luer sealing cap and attachment of the syringe to the luer lock, the container is squeezed to dispense product.

Additional objects, advantages and novel features of the invention will be set forth in part in the description which follows and in part will become apparent to those skilled in the art upon examination of the following or may be learned by practice of the invention. The objects and advantages of the invention will be realized and attained by means of the instrumentalities and combinations particularly pointed out in the appended claims.

BEST DESCRIPTION OF THE DRAWING

DESCRIPTION OF PREFERRED EMBODIMENT

Figure 1:
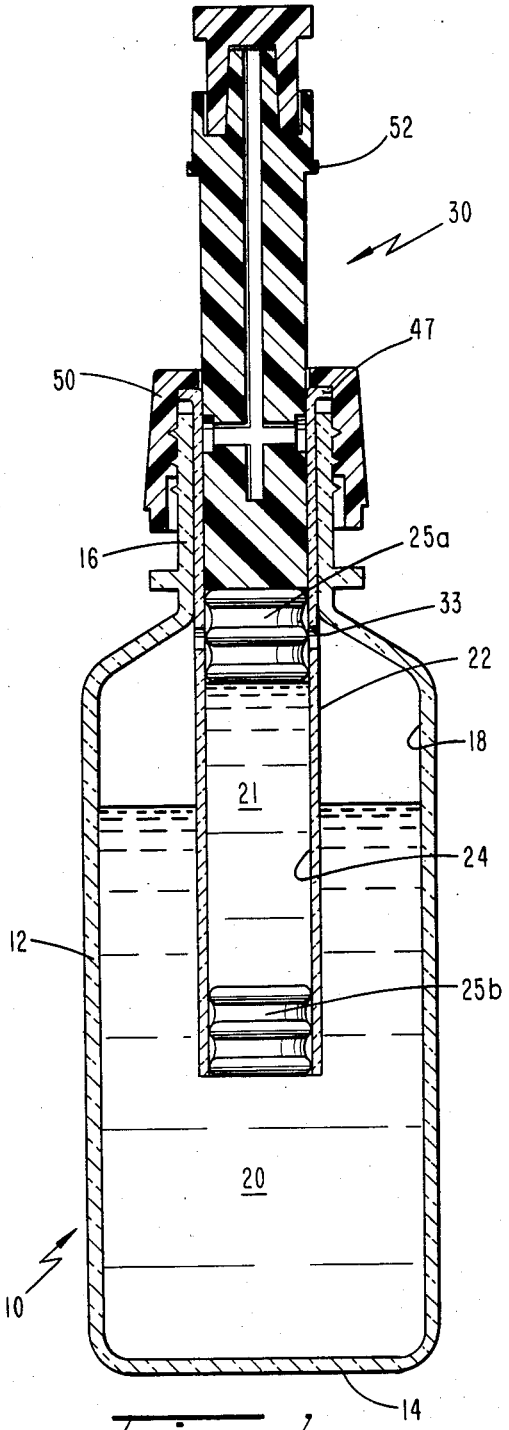
FIG. 1 is a cross-sectional view of the dispensing container according to the present invention with the plunger rod in position for separate storage of two products within the container.

Referring to FIG. 1, dual compartment container 10 of the present invention comprises a container body formed with a cylindrical side wall 12, bottom wall 14 and neck 16 establishing a cylindrical volumetric region 18 into which a substance 20 is stored. A cylindrical barrel 22 inserted into container 10 through neck 16 includes a compartment 24 located between upper and lower pistons 25*a* and 25*b*. A second substance 21 is stored within compartment 24 and separated from substance 20 by pistons 25*a*, 25*b*.

Upper piston 25*a* is fixed to a lower end of plunger 30 inserted into container 10 through the upper end of barrel 22. To displace lower piston 25*b*, one need merely apply finger pressure to telescope the plunger into the barrel. When plunger 30 is pushed downwardly, it transmits hydraulic force through substance 21 which acts upon lower piston 25*b*. The hydraulic pressure resulting from this action causes piston 25*b* to become dislodged and fall into the bottom of interior region 18, whereupon substance 21 enters the interior region and becomes intermixed with substance 20.

Figure 2:
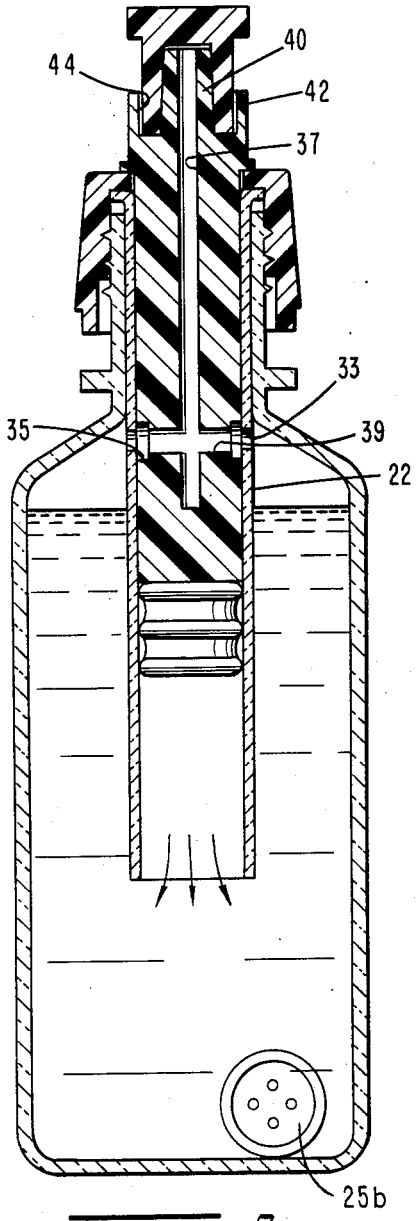
FIG. 2 is a view similar to FIG. 1 of the plunger rod telescoped into the barrel assembly to mix the two products together.
Figure 3:
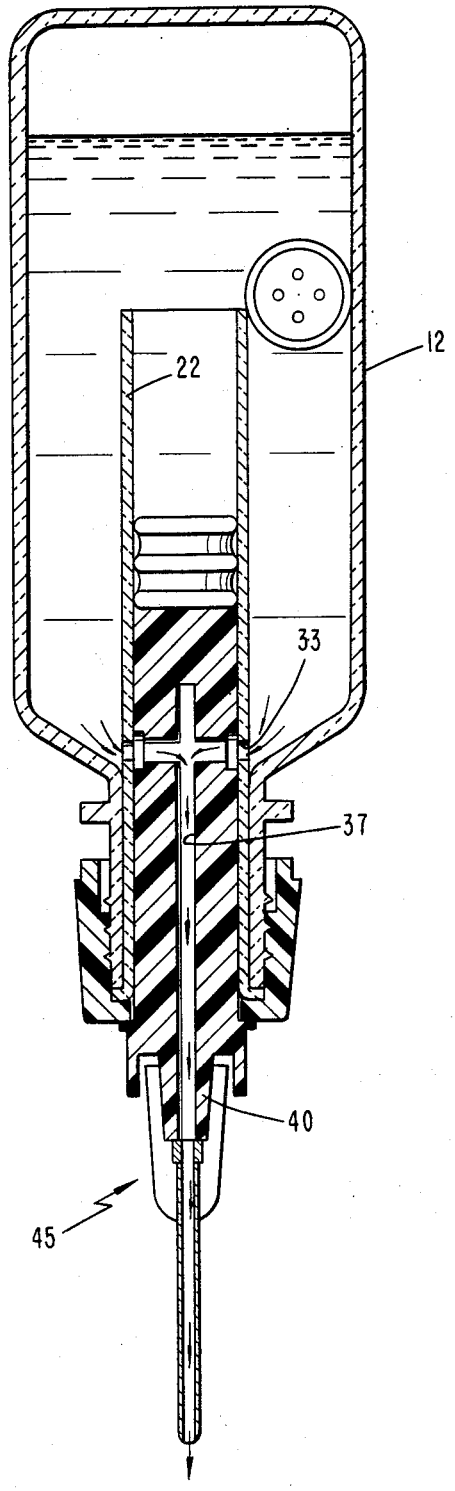
FIG. 3 is a view similar to FIG. 2 to depict dispensing of the mixed product through a syringe by squeezing the container side wall.

As shown in FIG. 2, as plunger 30 is telescoped into barrel 22 to mix substances 20 and 21, inlet ports 33 formed on barrel 22 enter into alignment with an annular passage 35 formed on the plunger rod. The annular passage 35 communicates with a forward end of the plunger rod through a longitudinal passage 37 and cross passage 39 as depicted in FIG. 2. This forward end is formed with a needle attachment stem 40 projecting centrally upward from a cylindrical wall 41 formed with a luer lock mechanism 44. The luer lock mechanism permits convenient, aseptic attachment of a hypodermic needle or cannula 45 to the needle attachment stem 40. The needle attachment stem 40 is normally covered by a cap 46 prior to attachment of a hypodermic needle or cannula. In the FIG. 3 position, mixed fluid is easily dispensed from container 10 by squeezing side wall 12.

Barrel 22 includes a smooth cylindrical side wall having an outer diameter slightly less than the internal diameter of the container neck 16 so that the two contact each other in sealing engagement. An annular retaining flange 47 is provided at the upper end of barrel 22 to properly locate the barrel within the container with the inlet ports 33 located in the uppermost portion of interior region 18. A closure cap 50 is then threaded to the container neck 16 to secure barrel 22 to the container.

Plunger rod 30 is formed with an annular stop flange 52 that limits the extent to which the rod telescopes into barrel 22. Contact between the stop flange 52 and the upper surface of the closure cap 50 indicates that the plunger rod is properly seated within the barrel allowing communication between the internal passageways formed within the plunger rod and the interior volumetric region 18 through the inlet ports 33.

The foregoing description of a preferred embodiment of the invention has been presented for purposes of illustration and description. It is not intended to be exhaustive or to limit the invention to the precise form disclosed, since many obvious modifications and variations are possible in light of the above teachings. The embodiment was chosen and described in order to best explain the principles of the invention and its practical application to thereby enable others skilled in the art to best utilize the invention and various embodiments and with various modifications as are suited to the particular use contemplated. It is intended that the scope of the invention be defined by the claims appended thereto.

What is claimed is:

1. A dual compartment dispensing container for storage of separate substances with internal mixing of same to form a single mixed fluid dispensable from the container at time of use, comprising:

(a) a container side wall forming an interior volumetric region for storage of one of said substances;

(b) a barrel assembly received within said container and formed with a compartment for storage of another substance therein, said barrel assembly including separating means for maintaining said stored substances separate from each other prior to mixing, said barrel assembly further including an inlet port and a piston for isolating said inlet port from said compartment, said barrel assembly defining a mixing region between the container side wall and an outer periphery of the barrel through which mixed fluid travels before entering said inlet port; and (c) a plunger rod containing a series of passageways therein and disposed within said barrel in coaxial alignment with said compartment, and including said piston advancing into the compartment upon depressing the plunger rod from an extended position into a telescoped position, the advancing piston exerting hydraulic pressure acting upon the separating means to allow mixing of said substances; said mixed fluid being dispensed from the container through a forward end of the plunger rod located outside the container and in communication with mixed fluid through said series of passageways in the plunger rod and said inlet port formed in the barrel, wherein said series of passageways includes a longitudinal passage formed in the plunger rod and open at one end thereof to the forward end and terminating at an opposite end thereof within the body of said rod, a cross passage interconnecting the longitudinal passage, said cross passage communicating with the container interior through said inlet port when the plunger rod is in the telescoped position, said inlet port being spaced from an end of said barrel assembly located outside the container by a distance sufficient to locate said inlet port in an upper portion of the volumetric region.

2. The container of claim 1, wherein said container side wall is formed of a flexible material being squeezable to dispense mixed fluid from the container.

3. The container of claim 1, wherein said piston includes plural flexible sealing rings, sealing off said passages from the inlet port when the plunger rod is in the extended position.

4. The container of claim 1, wherein said separating means comprises a second piston having flexible sealing rings disposed within the lower end of the barrel to define with the first piston opposite ends of said compartment.

5. The container of claim 1, wherein said barrel includes a cylindrical tube having an outer diameter about equal to the internal diameter of a neck portion of the container through which said barrel is inserted into the container, said barrel having a smooth exterior side wall contacting a corresponding smooth interior side wall of the neck in sealing engagement.

6. The container of claim 5, wherein an upper end of said barrel is formed with an annular retaining flange engageable with the container mouth to limit the extent to which the barrel enters the container.

7. The container of claim 6, including a plurality of inlet ports spaced from the retaining flange a distance sufficient to locate said ports in the uppermost portion of the volumetric region.

8. The container of claim 7, further including a closure cap threaded to the container neck to clamp said flange to the container mouth.

9. The container of claim 8, wherein said plunger rod is formed with an annular stop flange engageable with the closure cap to limit the depth to which the plunger rod telescopes into the barrel.

10. The container of claim 1, further including a needle assembly through which mixed fluid is dispensed from the container, said forward end of the plunger rod having a luer lock mechanism for fixing the needle assembly to the rod.

11. The container of claim 1, wherein said forward end of the plunger rod is formed with a luer lock mechanism to which a needle assembly is fitted to dispense mixed product from the container upon squeezing of the container side wall.

12. The container of claim 11, wherein said forward end of the plunger rod includes an attachment stem fitting with the needle assembly and a cylindrical wall having an inner surface formed with said luer lock mechanism.

* * * * *